US010229663B2

(12) United States Patent
Smith et al.

(10) Patent No.: US 10,229,663 B2
(45) Date of Patent: Mar. 12, 2019

(54) APPARATUS FOR A REED INSTRUMENT

(71) Applicant: Audio Inventions Limited, Worthing (GB)

(72) Inventors: Brian Smith, Worthing (GB); Paul Davey, Worthing (GB)

(73) Assignee: Audio Inventions Limited, Worthing (GB)

( * ) Notice: Subject to any disclaimer, the term of this patent is extended or adjusted under 35 U.S.C. 154(b) by 0 days.

(21) Appl. No.: 15/746,723

(22) PCT Filed: Jul. 25, 2016

(86) PCT No.: PCT/GB2016/052267
§ 371 (c)(1),
(2) Date: Jan. 22, 2018

(87) PCT Pub. No.: WO2017/013455
PCT Pub. Date: Jan. 26, 2017

(65) Prior Publication Data

US 2018/0218720 A1 Aug. 2, 2018

(30) Foreign Application Priority Data

Jul. 23, 2015 (GB) ..... 1513036.2

(51) Int. Cl.
*G10H 3/16* (2006.01)
*G10H 3/12* (2006.01)
*G10H 3/26* (2006.01)

(52) U.S. Cl.
CPC ..... *G10H 3/16* (2013.01); *G10H 3/125* (2013.01); *G10H 3/26* (2013.01);
(Continued)

(58) Field of Classification Search
CPC ..... G10H 3/16; G10H 2210/211; G10H 2220/491; G10H 2220/525; G10H 3/125; G10H 2230/205; G10H 2230/211
See application file for complete search history.

(56) References Cited

U.S. PATENT DOCUMENTS 2,138,500 A 11/1938 Miessner
3,558,795 A * 1/1971 Barcus ..... G10D 9/00 84/730

(Continued)

FOREIGN PATENT DOCUMENTS

CN 104810012 7/2015
DE 3839230 5/1990

(Continued)

OTHER PUBLICATIONS

Gibiat et al., "Acoustical Impedance Measurements by the Two-Microphone-Three-Calibration (TMTC) Method", The Journal of the Acoustical Society of America, American Institute of Physics for the Acoustical Society of America, New York, NY, US, vol. 88, No. 6, Dec. 1990, pp. 2533-2545.

*Primary Examiner* — Marlon Fletcher
(74) *Attorney, Agent, or Firm* — Jason P. Mueller; Adams and Reese LLP

(57) ABSTRACT

With reference to FIG. 7*a* the present invention relates to transducer apparatus (200) for use with a reed instrument (201) having an air chamber (15) forming a resonant cavity whose resonance characteristics are controlled by opening and closing of tone holes (17A, 17B) connecting the air chamber to the exterior of the reed instrument. The transducer apparatus comprises attachment means (202) for releasably securing the transducer apparatus to a mouthpiece (201) of the reed instrument in place of a reed. A reed replacement section (203) has a housing with an abutment
(Continued)

surface for abutting a surface part of the mouthpiece which would be abutted by a reed secured to the mouthpiece. An air passage extends through the housing of the reed replacement section (203) from an air inlet (211) through which a player of the instrument can blow to an air outlet (213) through which air blown by the player is delivered to atmosphere, without passing through the air chamber (15) within the reed instrument. A speaker (208) is supported by the housing and delivers sound to the air chamber (15). An air chamber microphone (209) is supported by the housing and receives sound in the air chamber (15). An electronic processing unit (204) has: an excitation unit (101) which produces an excitation signal for driving the speaker (208); a processor (102) for receiving a measurement signal produced by the microphone and for detecting from the measurement signal a musical note played by the instrument; a synthesizer (220) for generating an electronic signal embodying a musical note which corresponds to the detected musical note; and output means (103) for transmitting the musical note generated by the synthesizer to a receiver external of the transducer apparatus. The invention also relates to a system for representing the sounds of a reed instrument having the components of the transducer apparatus, to an electronic system for determining a musical note played by a reed instrument having the components of the transducer apparatus and to a method of practising playing of a reed instrument comprising use of the components of the transducer apparatus.

25 Claims, 7 Drawing Sheets

(52) U.S. Cl.
CPC . *G10H 2230/205* (2013.01); *G10H 2230/221* (2013.01); *G10H 2230/225* (2013.01); *G10H 2230/241* (2013.01); *G10H 2230/361* (2013.01)

(56) References Cited

U.S. PATENT DOCUMENTS

| | | | | |
|---|---|---|---|---|
| 3,571,480 | A | 3/1971 | Techenor et al. | |
| 4,233,877 | A | 11/1980 | Okami | |
| 5,131,310 | A | 7/1992 | Kunimoto | |
| 5,245,130 | A | 9/1993 | Wheaton | |
| 5,668,340 | A | 9/1997 | Hashizume et al. | |
| 5,929,361 | A | 7/1999 | Tanaka | |
| 7,220,903 | B1 * | 5/2007 | Bronen | G10D 9/02 84/383 R |
| 2006/0027074 | A1 | 2/2006 | Masuda et al. | |
| 2007/0068372 | A1 * | 3/2007 | Masuda | G10H 1/0008 84/723 |
| 2007/0144336 | A1 * | 6/2007 | Fujii | G10H 1/0008 84/723 |
| 2012/0230155 | A1 * | 9/2012 | Kawaguchi | H01L 41/332 368/47 |
| 2014/0224100 | A1 | 8/2014 | Vassilev | |
| 2015/0101477 | A1 | 4/2015 | Park et al. | |
| 2018/0090120 | A1 * | 3/2018 | Kasuga | G10H 1/043 |
| 2018/0218720 | A1 * | 8/2018 | Smith | G10H 3/125 |

FOREIGN PATENT DOCUMENTS

| | | |
|---|---|---|
| EP | 1585107 | 10/2005 |
| EP | 1760690 | 3/2007 |
| EP | 1804236 | 7/2007 |
| EP | 2650870 | 10/2013 |
| FR | 2775823 | 9/1999 |
| GB | 2537104 | 10/2016 |
| GB | 2559135 | 8/2018 |
| GB | 2559144 | 8/2018 |
| JP | 2002278556 | 9/2002 |
| JP | 2005122099 | 5/2005 |
| JP | 2007065197 | 3/2007 |
| JP | 2008076838 | 4/2008 |
| JP | 2013164542 | 8/2013 |
| JP | 2014232153 | 12/2014 |
| WO | 2018138501 | 8/2018 |
| WO | 2018138504 | 8/2018 |

* cited by examiner

APPARATUS FOR A REED INSTRUMENT

BACKGROUND OF THE INVENTION

The present invention relates to an apparatus that allows a player to quietly play a reed instrument, e.g. while practising.

The normal method of playing a reed instrument (e.g. clarinet, oboe, saxophone, bassoon) is well known. The user blows such that the reed vibrates, thus introducing a complex set of tones into the instrument. A resonant cavity is provided, having a plurality of keys. Depending upon which key(s) are depressed, resonance is produced such that a standing acoustic wave is formed that matches the resonance of the cavity. In this way the traditionally known notes are formed.

Typically when practising, it is desirable to reduce the noise output of reed instruments out of courtesy for those in the vicinity.

US 2014/0224100 A1 describes a system for use with bagpipes in which the normal reed is replaced with transducer apparatus comprising a speaker and a microphone. The speaker delivers sound to an air chamber of the bagpipes, the speaker being driven by a test signal comprising a periodic signal consisting of linear chirps, each linear chirp comprising only frequencies above 16 Khz, i.e. outside the audible range. The microphone detects the sound delivered to the air chamber and then the signal played by the speaker is correlated with the signal detected by the microphone to yield the response function of the acoustic system and thereby the musical note played by the instrument.

SUMMARY OF THE INVENTION

According to the present invention there is provided a system for representing sounds of a reed instrument according to claim 1.

The use of a pressure sensor enables the control of timing of operation of the system e.g. in the output of sound by the microphone to the air chamber or the output of synthesized musical notes.

Preferably the signal sent by the pressure sensor to the processing unit additionally indicates how hard the user is blowing through the mouthpiece. This can be used to vary volume of the synthesized musical note output or to recognise an octave shift which can be achieved in some reed instruments by the player blowing hard. Also the air pressure variations may be used to modulate the synthesized sounds, e.g. to recognise when the player is applying a vibrato breath input to the reed instrument and in response import a vibrato into the synthesized sounds.

Other preferred features of the system of the invention are set out in claims 3 to 23.

Preferably, the excitation unit is arranged to drive the speaker to produce sound at a volume chosen based on an amount of ambient noise. For example, the volume may be chosen to exceed ambient noise by a predetermined amount. The level of ambient noise may be measured using any known sensor, but is preferably measured using the microphone or by a separate ambient noise microphone measuring noise outside of the instrument. In one embodiment the user can select an operating mode in which the volume of sound produced by the excitation means can be manually selected.

The present invention allows a musician to practice with the system fitted to the reed instrument, without the generation of any significant noises which may disturb people nearby.

The output means may be one or more of: an interface for a computer; a wireless device for exchanging data over short distances using short-wavelength UHF radio waves; a MIDI (musical instrument data interface) connection; an HD protocol interface; and/or a transmitter.

The speaker and microphone may be mounted on a housing, the housing being adapted for attachment to an air chamber of a reed instrument such that the speaker and microphone are in communication with the air chamber. This allows for the system to be easily retrofitted to a musician's instrument. The speaker and microphone may be mounted on an inner surface of the housing in communication with a cavity formed therein, the housing being adapted for attachment to an air chamber of a reed instrument such that the speaker and microphone are in communication with the air chamber. Preferably the housing is adapted for attachment to a mouthpiece of a reed instrument and the housing is arranged to form a barrier between the mouthpiece and the air chamber.

In another preferred embodiment, the speaker and microphone may be mounted on a housing, the housing being adapted for attachment to an air chamber of a reed instrument such that the speaker and microphone are in communication with the air chamber; the housing forms a mouthpiece; a bore extends through the mouthpiece, the bore being separate from the cavity.

In yet another preferred embodiment, the mouthpiece may comprise a tip with an opening in communication with its bore. The mouthpiece comprises a false reed (in place of a normal reed) extending along the mouthpiece and, optionally, arranged to close the tip of the mouthpiece (although this is not essential). The false reed may be rigid so as not to vibrate when the user blows. The false reed has formed therein an air-pressure groove or air-pressure relief passage extending to a bleed hole formed in the false reed. This can be retrofitted onto existing instruments, and the air-pressure relief groove or passage can allow for the ejection of condensed moisture.

The air pressure sensor may be provided in the bore or in the air-pressure relief groove or passage. This allows the system to detect when the user is blowing and only play tones at these times. Additionally, as mentioned above, the strength of the blowing can be factored into the generation of the output signal and/or a vibrato input breath recognised and a vibrato element incorporated in the synthesized musical note.

The processing unit may be arranged to receive the measurement signal, recognise a played note from the measurement signal and then synthesize a corresponding musical note, the synthesis taking account of both the air pressure in the bore and a characteristic of a difference between the sound produced by the speaker and the sound received by the microphone.

The processor may generate an output signal by synthesising the sound of a reed instrument, with the frequency of the synthesised sound being based on frequency content of the measurement signal and also based on the air pressure sensed by the air pressure sensor, and with the amplitude of the synthesised sound being based on the air pressure sensed by the air pressure sensor.

The present invention also provides a method as claimed in claim 24 an apparatus for use in such a method as claimed in claim 25.

The present invention further provides transducer apparatus as claimed in claim 26. Such transducer apparatus provides a unit conveniently attachable to a reed instrument in place of a reed which will allow a player to practice playing the reed instrument without the generation of any significant noise which might trouble others in the vicinity. Preferred features of the transducer apparatus are set out in claims 27 to 34. The transducer apparatus can form part of a practice system as claimed in claims 35 and 36. The communication between the transducer apparatus and a laptop, tablet or personal computer or a smartphone allows for a better learning experience for the player practicing playing of the reed instrument, e.g. graphical representations of played musical notes can be compared against graphical representations of 'ideal' played musical notes. Also musical scores and training exercises can be presented to the player.

The present invention provides an electronic system for determining a musical note played by a reed instrument as claimed in claim 37, with a preferred feature of this system given in claim 38. The system of both claims allows the sound delivered by the speaker to be a low scarcely audible level, since ambient noise is removed from the measurement signal.

The present invention provides an electronic system for determining a musical note played by a reed instrument as claimed in claim 39, with preferred features of the system given in claims 40, 41 and 42. The system of all three claims uses an exponential chirp which has a lowest frequency in the audible range, corresponding at least approximately to a lowest musical note playable by a reed instrument. In contrast the system of US 2014/0224100 A1 uses a chirp which a linear rather than an exponential chirp and one that only comprises frequencies above 16 Khz, i.e. above the audible range of frequencies. Using a linear chirp means that only a smaller range of frequencies can be included in the chirp and this does not allow for recognition of a shift of frequencies occasioned in a reed instrument e.g. by the use of a register shift key. The prior art uses a high energy signal outside the audible range, whereas the present invention uses a low volume signal including frequencies in the audible range. This can provide the effect of playing a near-silent instrument while providing for reliable musical note recognition.

The present invention provides an electronic system for determining a musical note played by a reed instrument as claimed in claim 43, with preferred features of the system given in claims 44, 45 and 46. The selection of an excitation signal with components corresponding to played notes allows for reliable musical note detection from the measurement signal and allows for use of a filter bank with filters tuned to the relevant musical notes. This can provide the effect of playing a near-silent instrument while allowing for reliable musical note detection.

The present invention provides an electronic system for determining a musical note played by a reed instrument as claimed in claim 47, with preferred features of the system given in claims 48 and 49. The systems claimed employ a feedback arrangement in which the excitation signal is adapted following an initial detection of a played musical note so that it contains frequencies better suited to detection of the played musical note in the measurement signal. This can provide the effect of playing a near-silent instrument while allowing for reliable musical note detection.

The present invention provides a method of practising playing of a reed instrument as claimed in claim 50, with preferred versions of the method set out in claims 51 to 58. Further methods of practising playing of a reed instrument are provided as claimed in claims 59 and 60. The methods allow a player to easily and quickly convert his/her own reed instrument into a version which allows near silent practice.

BRIEF DESCRIPTION OF THE DRAWINGS

For a better understanding of the invention, and to show how the same may be put into effect, reference is now made, by way of example only, to the accompanying drawings in which.

DETAILED DESCRIPTION

While the detailed description will be made with reference to a clarinet, it will be appreciated that this is by way of example only and the present invention can be used with any suitable wind instrument (in particular, a reed instrument).

The acoustics of reed instruments, e.g. clarinet, oboe, saxophone, bassoon are well known. The player provides wind energy such that the reed vibrates thus introducing a variety of tones into the instrument. Depending upon which key(s) are depressed a resonant cavity is produced in the air chamber of the instrument such that a standing acoustic wave is set up matching the resonance of the cavity, and the result is the sound which is recognised aurally as the played musical note. The terms first harmonic and fundamental are often used as alternative terms for the lowest frequency component of the played musical note; i.e. the frequency which is aurally perceived.

Figure 1:
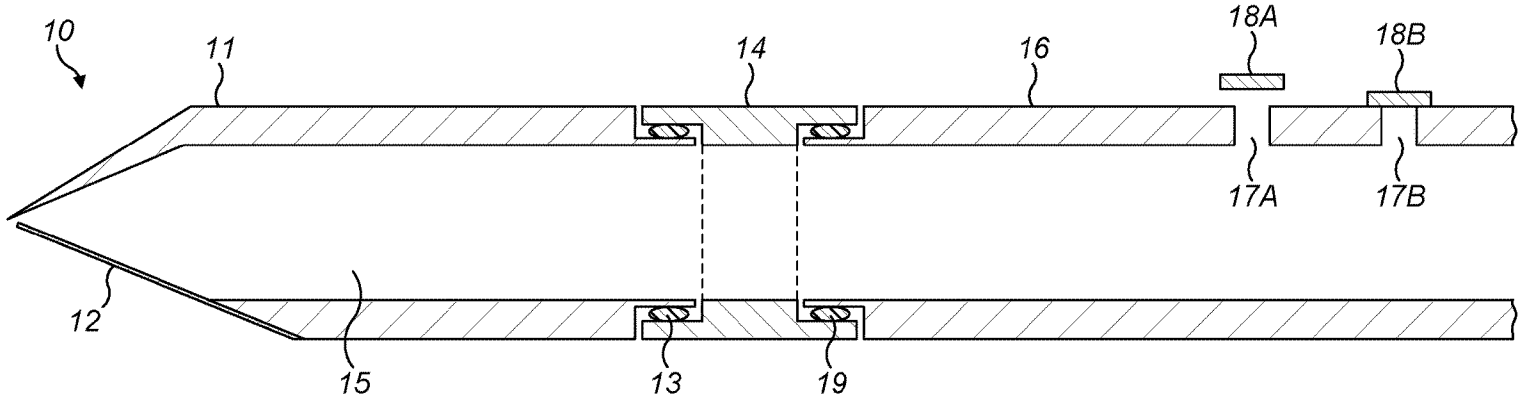
FIG. 1 is a simplified cross-sectional view of a conventional clarinet.

With reference to FIG. 1, there is shown a simplified cross-section of a part of a typical clarinet 10. Shown in figure is a mouthpiece 11 which is substantially cylindrical and hollow. At a proximal end of the mouthpiece, a reed 12 is attached to the mouthpiece 11 with a ligature (not shown). At a distal end, the mouthpiece 11 has a cutaway section of reduced outer diameter. Embedded in this section is a tenon cork 13 which extends around the periphery of the reduced diameter section.

The clarinet 10 also comprises a barrel 14 (also known as a socket) which is again cylindrical and hollow. The barrel 14 has an outer and an inner diameter substantially similar to those of the mouthpiece 11. A section of the inner diameter of the barrel 14 is removed at a proximal end thereof so as to seal with the tenon cork 13 of the mouthpiece 11.

A distal end of the barrel 14 engages with an upper joint 16 of the clarinet 10. Again a section of the inner diameter of the barrel 14 is removed at the distal end thereof so as to seal with a tenon cork 19 of the upper joint 16. The upper joint 16 is provided with a plurality of tone holes, only two of which are shown at 17A, 17B, over which are mounted tone hole rings and keys 18A, 18B. The keys can either be in an undepressed state 18A, or a depressed state 18B, to uncover or cover the holes 17A, 17B, respectively. The upper joint 16 is then in turn attached to a lower joint and a bell (not shown) to form the completed clarinet. These components define a cylindrical air chamber 15 which extends throughout the clarinet 10.

To play the clarinet 10 a user blows into the mouthpiece 11, causing the reed 12 to vibrate. Standing waves are formed in the air chamber 15, which is shaped such that these correspond to the commonly known musical scale. Opening and closing of the holes 17A, 17B alters the shape of the generated standing wave, and hence the musical note produced.

Figure 2:
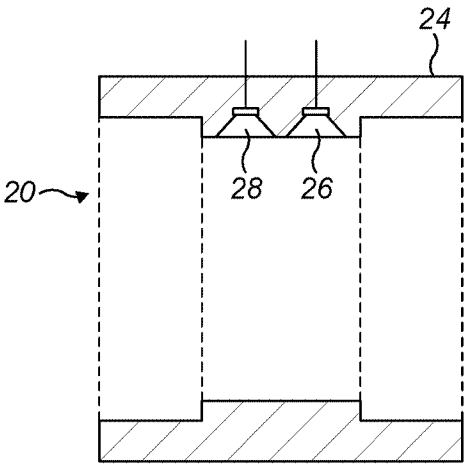
FIG. 2 is a cross-sectional view of the barrel section of a clarinet according to an embodiment of the present invention.
Figure 4:
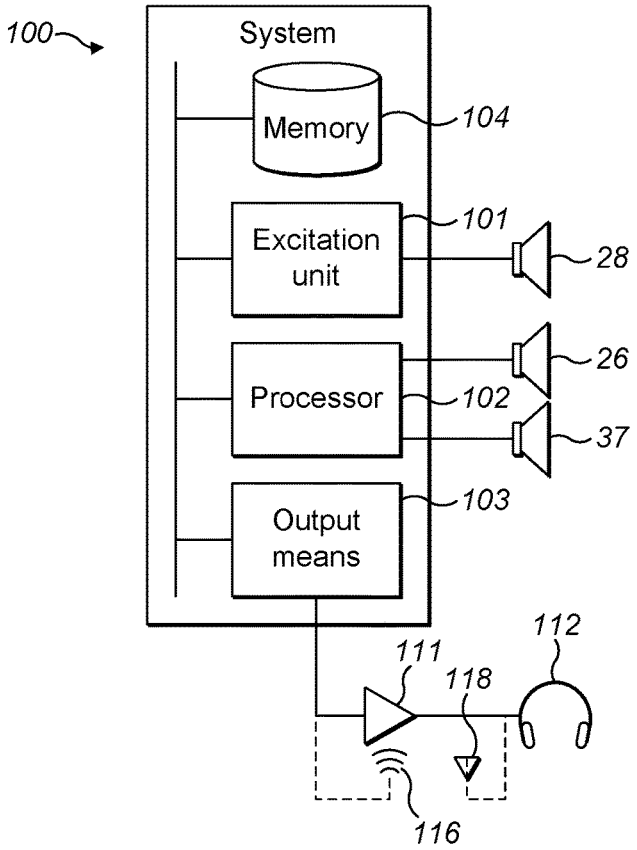
FIG. 4 is a schematic representation of an electronic control unit as used by any of the described embodiments of the invention.

In a first embodiment of the present invention, the barrel 14 of FIG. 1 is replaced with the barrel 20 of FIG. 2. This barrel 20 comprises a speaker 28 and a microphone 26, both of which are provided in the air chamber 15. As shown in FIG. 4, the speaker 28 is driven by an excitation unit 101 (part of an electronic processing unit 100) to produce a sound. The sound may be particularly quiet, or may be outside of the frequency range of human hearing. The sound must be suitable for forming an acoustic wave in the air chamber 15 which is characteristic of the combination of keys 18A, 18B which are depressed. The sound delivered by the speaker 28 to the air chamber 15 is modified by the acoustic transfer function of the air chamber 15. The sound in the air chamber 15 (which will include the sound delivered by the speaker 28 to the air chamber) is measured by the microphone 26, which outputs a measurement signal representing the measured sound. The acoustic transfer function of the air chamber 15 is set by the player of the reed instrument, by opening and closing the tone holes (e.g. 17A, 17B) which are located along the length of the instrument and which connect the air chamber 15 of the instrument to the exterior of the instrument at a plurality of different locations spaced out along the length of the air chamber 15, as will be further described later. These tone holes (e.g. 17A, 17B) may be opened and closed directly by fingers of a player of the reed instrument or by tone hole rings which are connected to keys manually controlled by a player of the reed instrument. The combination of open and closed tone holes (e.g. 17A, 17B) selected by the player dictates what musical note is played by the instrument. In normal use of the reed instrument the vibration of the reed 12 by the player blowing across the reed 12 generates a sound which is then modified by the acoustic transfer function of the air chamber 15 to generate a music note output from the reed instrument, typically via a bell portion at an end of the air chamber 15 opposite to the mouthpiece 11 of the reed instrument. The timing, tone and volume of the sound produced will also be affected by when and how hard the player of the reed instrument blows into the mouthpiece 11 of the instrument 10.

The present invention recognises that it often hard for players of reed instruments to practice without unduly disturbing others and so provides an arrangement by which the player can still blow into the mouthpiece 11 and open and close the tone holes (e.g. 17A, 17B) in the normal manner, but without generating sound that will disturb others. Instead the speaker 28 will deliver a largely or totally inaudible sound to the air chamber 15 of the instrument 10, which will be modified by the acoustic function of the air chamber 15 as selected by the player by opening and closing the tone holes (e.g. 17A, 17B), the modified sound then forming part of the sound in the air chamber 15 which is received by the microphone 16, which will output a measurement signal from which can be determined which musical note has been selected by the player of the instrument by the opening and closing of the tone holes 17A,17B. The measurement signal can be then used by the system to produce a sound delivered e.g. by headphones to the player, so that the player can hear the musical note played without the instrument producing a sound which would disturb others. As will be described below, a pressure sensor separate and independent from the microphone can be used to determine when and how hard the player is blowing into the mouthpiece 11 (which will not have a functioning reed), so that the timing and volume of the musical notes delivered as sound, e.g. via headphones to the player, can be varied accordingly.

The apparatus of the first embodiment has an operating mode for playing the instrument in a manner that is substantially inaudible, for instance the apparatus may be arranged to limit the power output of an excitation unit 101 (see FIG. 4) to drive the speaker 28 to produce sound at a low volume. The low volume may be selected based on a measurement of ambient sound. The measurement of ambient sound may be taken by the microphone 26. Alternatively an additional microphone can be provided which is directed not into the air chamber 15, but instead is directed outwardly of the instrument 10 to directly measure the ambient sound outside the musical instrument 10.

For example, the power output of the speaker 28 may be chosen to be greater or less than the measured ambient sound level by a predetermined amount or by a predetermined factor.

Preferably, when the measurement of ambient sound is taken by the microphone 26 (or by a second ambient noise microphone), the power output of the speaker 28 is chosen to be greater than the measured ambient sound level by a predetermined amount or by a predetermined factor. In such embodiments, the power output of the speaker 28 may be a factor of two or more times the power of the ambient noise received by the microphone 26 (or the second ambient noise microphone).

In this way, the selection of power output can be configured (for a given instrument) such that the sound produced by the speaker 28 is expressed by the reed instrument at a level that will effectively allow the instrument to be played quietly such that it cannot be heard over the sound of the ambient noise.

In a preferred embodiment the apparatus is arranged to excite the speaker 28 such that the frequency of sound produced by the speaker 28 is between 20 Hz and 20 KHz. The excitation signal sent to the speaker 28 preferably comprises a series of exponential chirps. The chirp will preferably excite a selected range of audible frequencies equally. Each chirp is preferably an exponential chirp, sometimes called an exponentially scanned chirp or a geometric chirp, but could be a concatenated set of sine-waves at carefully selected frequencies. In an exponential chirp the frequency of the signal varies exponentially as a function of time: $f(t)=f_0k^t$, where $f_0$ is the starting frequency (at t=0) and k is the rate of exponential change in frequency. Unlike a linear chirp, an exponential chirp has an exponentially increasing frequency rate. The exponential chirp will provide equal frequency discrimination to each musical note of the instrument and therefore address the issue that the signal to noise ratio can be higher for some musical notes due to the presence of ambient noise, which could otherwise lead to poor musical note recognition.

Figure 8:
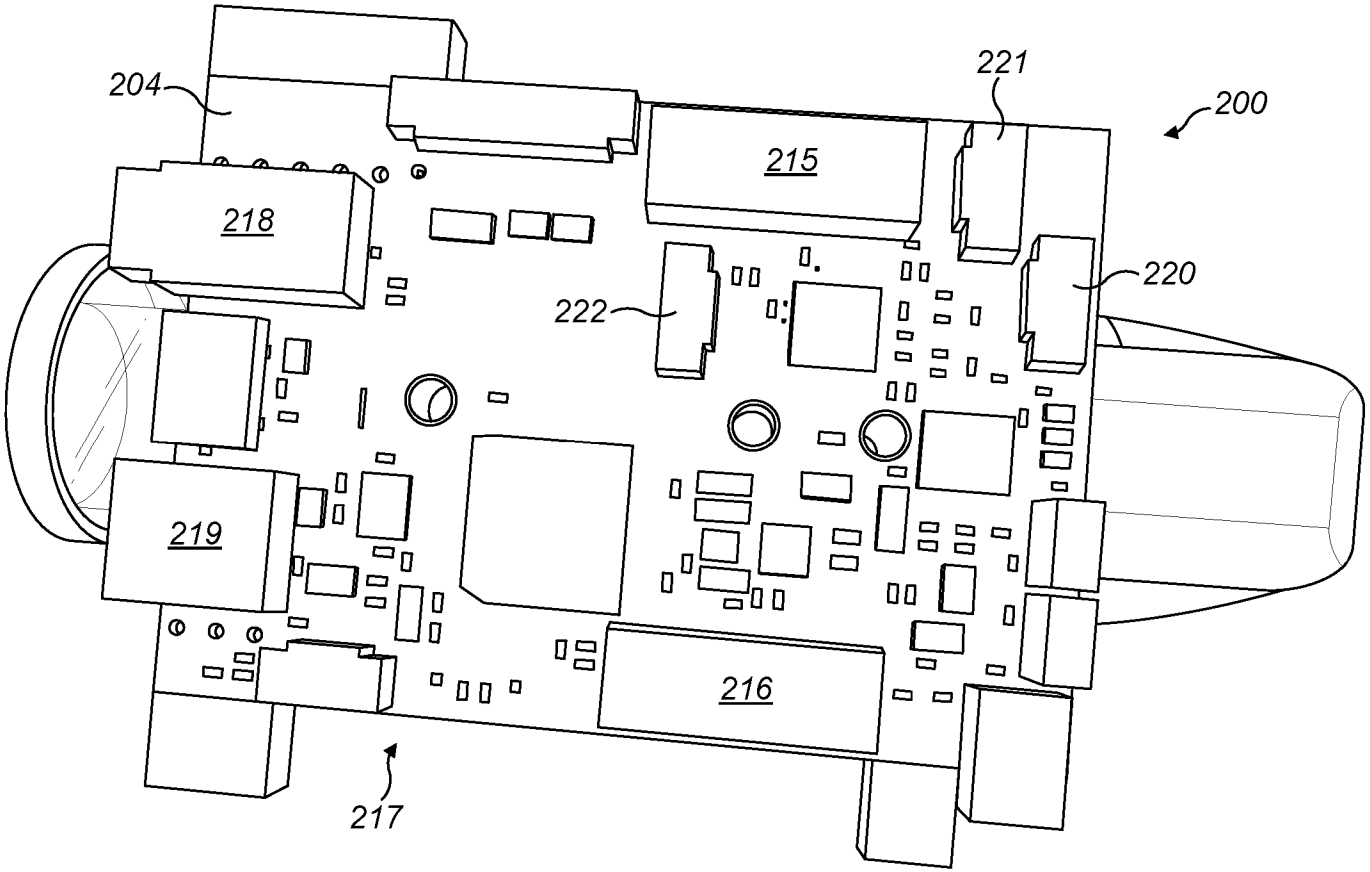
FIG. 8 is a perspective underneath view of the transducer apparatus of FIGS. 7*a* and 7*b:*

The microphone 26 then picks up the acoustic waveform in the air chamber 15, which will contain the waveform output by the speaker 28 modified by the acoustic transfer function of the air chamber 15, such acoustic transfer function being selected by the player of the reed instrument by the opening and closing of tone holes. This signal is passed to the processor 102 (see FIG. 4). The processor 102 analyses this signal to detect which musical note is being played. The processor 102 compares the frequency domain analysis of the measurement signal with a set of stored frequency domain analyses, each of which correlates with a musical note played by the reed instrument. The processor 102 determines for each measurement signal the Pearson correlation coefficient between the measurement signal and the set of stored signals to select the stored signal which most closely correlates with the measurement signal. The stored signal selected in this way will correlate with a musical note played by the reed instrument. The processor 102 incorporates a synthesizer (220 in FIG. 8) which generates a signal embodying this musical note to output means 103. The output means 103 is then connected via amplifier 111 to headphones 112 in order to reproduce the synthesized musical note to the user wearing the headphones 112. Alternatively, or in addition, wireless transmission means 116, 118 may be incorporated in the apparatus such as wireless transmission means using the Bluetooth® wireless technology standard for exchanging data over short distance distances (e.g. using short-wavelength UHF radio waves in the ISM (industrial, scientific and medical) radio band from 2.4 to 2.485 GHz). The wireless transmission means will transmit a signal for use by the headphones 112.

Whist it is possible that the invention could be implemented and used with a conventional reed still in place and the user refraining from blowing, it will be more typical that to implement the invention the mouthpiece of the reed instrument will be replaced by a modified mouthpiece which is part of the apparatus of the invention or, more preferably, the regular mouthpiece of the instrument will be modified by removing the regular reed and replacing this with a reed substitute according to the invention, as will be described more fully later. In this manner the user can practice the instrument very quietly without disturbing others within earshot. Optionally, a vent hole is provided either in the modified mouthpiece or in the substitute reed to ensure that the user feels the same resistance to blowing as would be felt with a normal mouthpiece.

Figure 6:
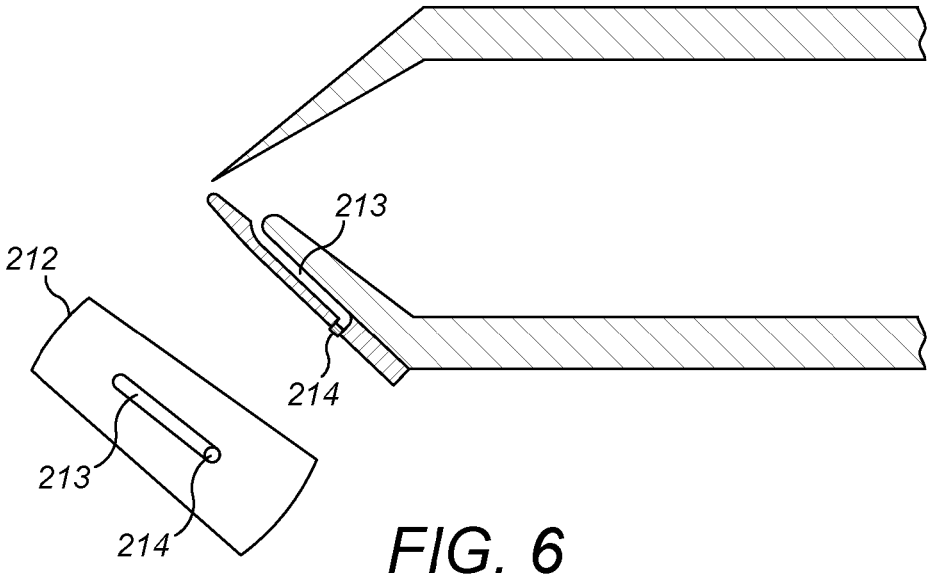
FIG. 6 shows a false reed for use in the embodiments of FIGS. 5*a* and 5*b;*

FIG. 6 shows one way in which a substitute reed 212 may be provided. The tip of the regular mouthpiece 11 of the reed instrument comprises an opening in communication with the bore of the mouthpiece. The substitute reed 212 may be applied to the mouthpiece in place of the normal reed 12. It will be a stiff non-vibrating reed. The substitute reed 212 may, optionally, be configured to close the opening at the tip of the mouthpiece 11. Advantageously, the substitute reed 212 may have formed therein an air-relief groove 213 along a surface of the substitute reed 212, or an air-relief passage extending through the substitute reed 212, from a first location to a bleed hole 214. The first location is selected to receive a flow of breath from the user.

If a groove 213 is provided (as shown in FIG. 6), this can cooperate with the mouthpiece to collectively form an air-relief passage. This can give a player the impression that he/she is playing the instrument normally, but without allowing excitation of the air chamber. A pressure sensor 37 can be mounted in the passage 213 (for example, as an alternative to the location of the sensor 37 in FIGS. 5*a* and 5*b*).

The pressure sensor 37 may send a signal to indicate when and/or how hard and/or in what manner (e.g. vibrato) the player is blowing through the passage 213. The substitute reed 212 of FIG. 6 will typically be used in conjunction with the apparatus of FIG. 5A or FIG. 5B. The use of the substitute reed 212 will remove the need for the passage 313 in the apparatus of FIG. 5A and FIG. 5B.

While the embodiment of FIG. 4 depicts an output signal being transmitted to headphones 112, the signal may be sent to any suitable device such as, but not limited to, speakers, an internet connection, mixing console or games console. The signal generated does not necessarily have to be used by the device to mimic the output of the reed instrument being played. It could, for instance, be used as part of a computer game in which the user is rewarded for playing the correct note at the correct time, or an instrument different from that being played could be synthesized.

Figure 3:
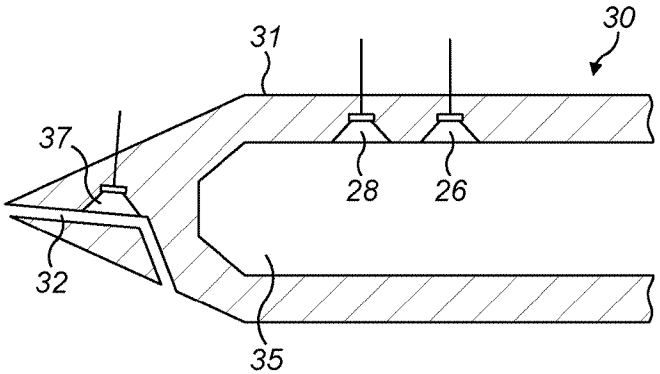
FIG. 3 is an cross-sectional view of a mouthpiece for a clarinet according to another embodiment of the present invention.

FIG. 3 depicts an alternative embodiment of the present invention. In this embodiment a new mouthpiece 30 is provided. The mouthpiece 30 comprises speaker 28 and microphone 26 which act as per the previous embodiment. In this embodiment, the bore 35 does not have an opening at the proximal end of the mouthpiece, so the air chamber is sealed off the mouthpiece end thereof. Instead, a small bore 32 is provided through the mouthpiece 30, which has an outlet to the exterior of the mouthpiece 30. This bore 32 may be shaped so as to mimic the usual air-pressure characteristics of the clarinet 10 as it is being played. The bore 32 does not communicate with the air chamber 35.

The bore 32 is provided with a pressure sensor 37, which sends a signal to the processor 102 (see FIG. 4) to indicate when and/or how hard the user is blowing through the mouthpiece 30. The processor 102 then uses this data to decide when to initiate the speaker 28, and/or the microphone 26 and/or generation by the synthesizer 220 (see FIG. 8) of a musical note output signal, and/or operation of the output means 103. The signal may also be used to alter the characteristics of the synthesized music note signal, such as representing a higher pitch when a high pressure is sensed or introducing a vibrato element to the synthesized musical note.

Figure 5A:
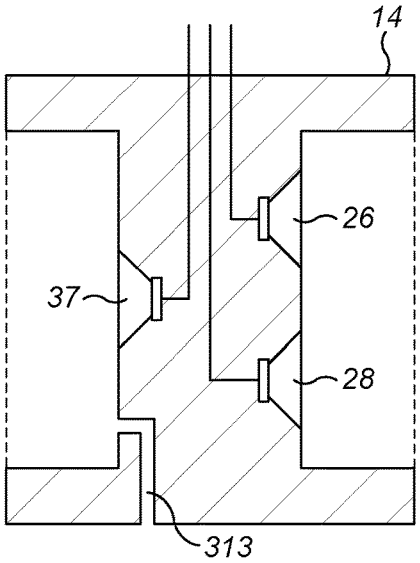
FIG. 5*a* shows another embodiment of the present invention.

A further alternative is shown in FIG. 5*a*. FIG. 5*a* shows transducer apparatus for attachment between the mouthpiece 11 and a main body of an instrument (e.g. an upper joint of a clarinet). In FIG. 5*a*, the transducer apparatus is formed in the shape of and as a replacement to a barrel 14 of a clarinet. The FIG. 5*a* transducer apparatus comprises a barrier to isolate the mouthpiece 11 from the air chamber 15 in the main body of the instrument. The speaker 28 and microphone 26 are arranged to be in communication with the air chamber 15 in the main body of the instrument, while the pressure sensor 37 is arranged to be in communication with the mouthpiece 11. For example, the speaker 28 and microphone 26 may be mounted on the opposite side of the barrier to the side on which the pressure sensor 37 is mounted.

Figure 5B:
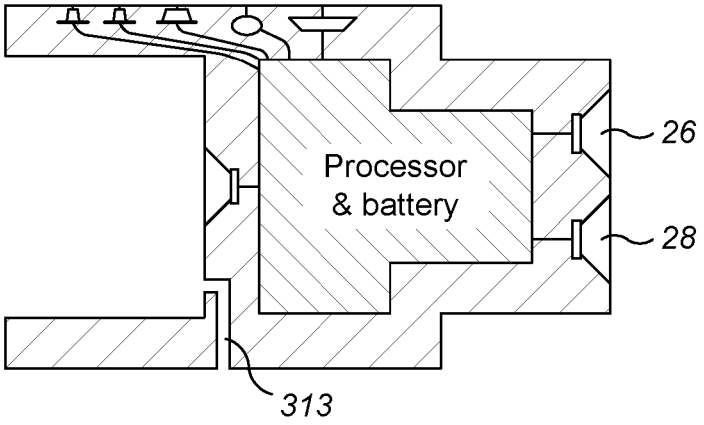
FIG. 5*b* shows a preferred version of FIG. 5*a;*

A further version of transducer apparatus according to the present invention is shown in FIG. 5*b*. In this variant, a barrier between the mouthpiece and the remainder of the instrument comprises a housing containing a battery for powering the transducer apparatus and also the electronic processing unit 100 of the device (including one or more of the excitation unit 101, the processor 102, the output means 103, and the memory 104). There may additionally be provided in or on the housing: a charging and/or communication connection point (such as a micro-USB connector), which may be part of, or additional to, the output means 103; a socket for headphones; controls for activating the device or its various features; and/or a status display (such as one or more LEDs).

Whilst the transducer apparatus shown with in FIG. 5*a* has two female connectors (for connection to male connectors of the main body and mouthpiece) and the transducer apparatus of FIG. 5*b* has one male and one female connector, each of the shown transducer apparatus may be configured to have any combination of male and/or female connectors necessary to interfit with a desired reed instrument. The transducer apparatus of FIG. 5*a* is designed to replace a barrel of a clarinet, whilst the transducer apparatus of FIG. 5*b* could be provided in addition to a barrel of a clarinet (preferably, between the barrel and the mouthpiece, where sizes are typically standardised).

Each of transducer apparatus of FIGS. 5*a* and 5*b* may have formed therein a passage 313 from the mouthpiece side to a bleed hole 214. This can give players the impression that they are playing the instrument normally, but without allowing them to excite the air chamber 15 themselves. The pressure sensor could be mounted in the passage 313.

FIG. 4 shows a schematic representation of a system for synthesizing the sound of a reed instrument. The system of FIG. 4 may be used with either of the structural arrangements given above or any of the embodiments mentioned below. There are a variety of well-known techniques for analysing a resonant cavity to measure or estimate its resonance. These include, but are not limited to, application of maximum length sequences, time-domain reflectometry, swept sine analysis, chirp analysis, and mixed sine analysis. Irrespective of the embodiment, or the processing approach, it has been found to be advantageous for the speaker 28 and the microphone 26 to be separated by a distance of less than 5 cm.

In some embodiments of the invention, a method based upon the application of simple sine tones is used. A stimulus frame comprises tones chosen for each of the possible notes of the clarinet 10 (or other reed instrument). The tones can be applied discretely or contiguously one after another. Each tone may be formed of more than one frequency component. A stimulus-frame comprises the tones arranged in a known order.

The stimulus-frame is applied as an excitation to the loudspeaker 28. Excitation may be carried out periodically, or may commence after an event (such as when the pressure sensor 37 senses the user has blown into the mouthpiece). The microphone 26 picks up the stimulus-frame and the resonances generated and passes this information to the processor 102. The processor applies a filter bank or fast Fourier transform in order to measure the intensity of the received sound signal at different frequencies. From the intensity measurements it is possible to identify the musical note played by the player of the reed instrument.

The processor 102 may use data from the pressure sensor 37 to decide when to initiate the speaker 28, and/or the microphone 26 and/or generation of the output signal, and/or operation of the output means 103. The signal may also be used to alter the characteristics of the output signal generated by the synthesizer 220 (see FIG. 8) incorporated in the processor 102, such as representing a higher pitch when a high pressure is sensed. In preferred embodiments, the speaker 28 may be continually active during operation. For example, the speaker 28 may be driven to produce a repeated sequence of sounds. In this case, the processor 102 can use the signal from the pressure sensor 37 to restart the sequence. Also air pressure variations measured by the pressure sensor 37 may be used to modulate the synthesized musical note generated by the synthesizer (220 in FIG. 8), e.g. to recognise when the player is applying a vibrato breath input to the reed instrument and in response import a vibrato into the synthesized musical note.

A predetermined set of stimulus-frames may be stored in memory 104.

The system may be programmed to learn the response of the instrument 10 to one or each tone within a stimulus-frame. For example, the user may be instructed by a user interface to depress the keys 18 required to play one or more notes (perhaps, all possible notes) in order to characterise the resonance of the instrument 10. Whilst each key 18 is depressed, the excitation unit 101 excites the loudspeaker 28 with a stimulus-frame and the response is received using the microphone 26. The processor 102 can analyse the received response and use this to store a representation of the played musical note in memory 104. In this way, the system can adapt to the particular instrument 10 to which it is applied.

Alternatively, or in addition, the learning process can be used to adapt the stimulus-frame. For example, if the microphone 26 receives sound energy having a primary fundamental frequency (e.g., the lowest received frequency) that is higher than that of a tone transmitted by the speaker 28, the processor may increase the frequency of that tone of the stimulus frame, or all of the tones of the stimulus frame, by a factor equal the ratio of the primary fundamental frequency received by the microphone 26 to the tone that was transmitted by the speaker 28.

Alternatively the processing unit 100 comprising the excitation unit 101, the processor 102, the output means 103 and the memory 104, can generate from the measurement signal sent by the microphone 26 to the processor 102 an output signal comprising a time series of data characterising a difference between the sound produced by the speaker 28 driven by the excitation unit 101 and the sound received by the microphone 26. The excitation signal produces by the excitation unit 101 can be relayed to the processor 102 to allow direct comparison with the measurement signal received by the processor 102 from the microphone 26. The difference is indicative of the acoustic transfer function of the air chamber 15 and this is turn indicates the musical note played by the player; thus the processor 103 can select the musical note played, e.g. by comparing the indicated acoustic transfer function with a series of acoustic transfer functions stored in the memory 104 (each of which would be associated with a particular musical note). The synthesizer 220 (see FIG. 8) of the processor 102 can then synthesize the musical note selected to be output by the output means 103 e.g. to the headphones 112.

When a player is playing the instrument 10 of the embodiment of FIG. 2, the player may adopt the usual pose, but need not blow into the instrument. Alternatively, the reed of the mouthpiece may be removed so that the player can blow without forming a note that can resonate. In this case, the synthesis of a musical note may be triggered by a key press (either a key 18 of the instrument, or a separate key provided for this purpose). Micro-switches could be associated with one or more keys to allow this, with the micro-switches sending key position signals to the processing unit 100 for use thereby.

When a user is playing the instrument 10 of the embodiment of FIG. 3, the user will blow into the instrument, but the flow of air will not reach the air chamber 15. The air pressure sensor 37 will sense the change in pressure and provide a pressure signal to the processor 102. The pressure signal 102 can be used to indicate when a note should be synthesized. For example, synthesis of a note may be commenced when the air pressure sensor 37 senses a pressure exceeding a threshold and ceased when the pressure drops below a/the threshold.

The pressure signal 102 can also be used to trigger the excitation of the loudspeaker 28. For example, the excitation may be triggered when the air pressure sensor 37 senses a pressure exceeding a threshold and continued until the pressure drops below a/the threshold. When the stimulus-frame method is used, the stimulus frames may be repeated during the excitation. In embodiments in which the speaker 28 continually produces a repeated sequence of sounds, the processor 102 can use the signal from the pressure sensor 37 to restart the sequence.

The pressure signal also represents the volume of note intended to be played by the user. The processor 102 instructs the output means 103 to synthesize a note having a volume that depends on the sensed pressure.

For some instruments 10, the pressure of air provided by the user can also affect the note played. In some embodiments, the synthesizer (220 in FIG. 8) in the processor 102 will synthesize a note having a pitch that depends on the sensed pressure. Furthermore the pressure signal can indicate when the player is applying a vibrato to the reed instrument and when this is detected then the synthesizer (220 in FIG. 8) will generate a musical note signal incorporating a vibrato element.

Irrespective of how the microphone 26, speaker 28, and optional air pressure sensor 37, are mounted (i.e. as in the case of FIG. 2, 3, 5 or 6), the system may work in the same way. The system can be applied in a variety of ways, including the following.

Quiet play: the system may be provided with a quiet operating mode in which the excitation unit 101 is arranged to drive the speaker 28 to produce sound at a volume selected based on a measurement of ambient sound. The measurement of ambient sound may be taken by the microphone 26 (or a separate and independent ambient noise microphone). In this way, the instrument can be "played" by the user (either without blowing, or with the breath redirected as in FIGS. 3, 5, and 6) without generating sound via the instrument in the normal way, but such that the output means 103 produces an output signal that can drive headphones or the like for playing the synthesized sound to the user. Thus, the user can practice quietly.

Game interface: the output means 103 may be adapted to provide a signal to a computer programmed to challenge the user to play a certain piece of music. The computer may display in real-time the notes played and/or score the ability of the user to play the piece of music, based on timing and/or frequency of the signal produced by the microphone 26. This may optionally also apply the quiet operating mode.

Virtual orchestra: the output means 103 may be adapted to provide a signal to a communications device (e.g., an internet connection). The communications device may receive signals from other such devices and/or other types of instrument and synthesize the sound of a plurality of instruments playing simultaneously. Again, this may optionally also apply the quiet operating mode.

Figure 7A:
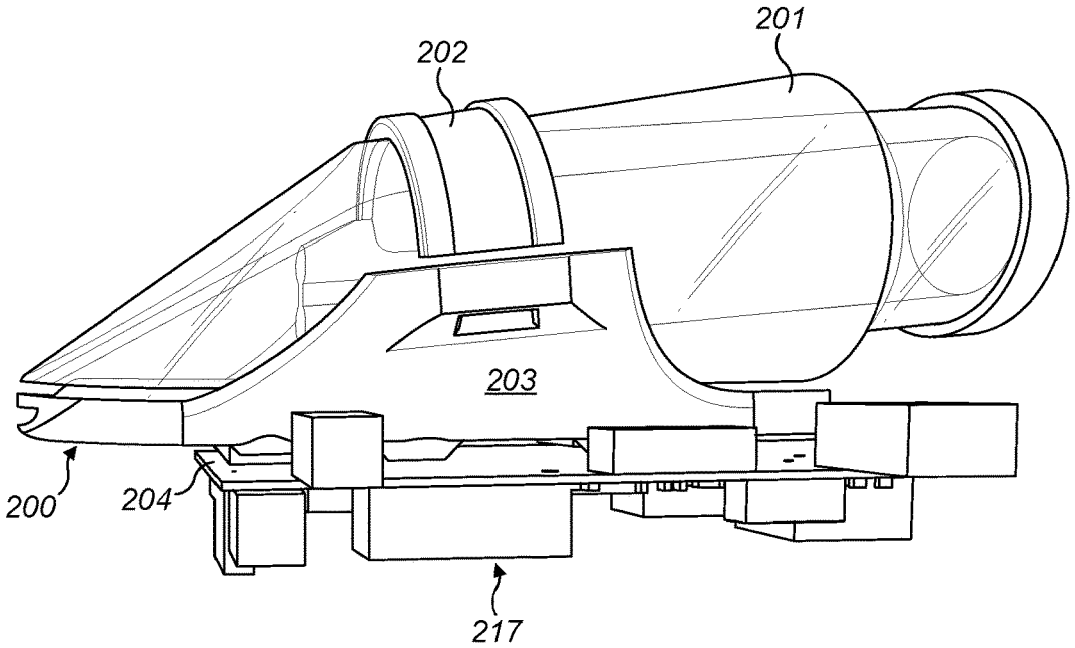
FIGS. 7*a* and 7*b* both show a perspective view of transducer apparatus for use with a reed instrument according to an embodiment of the invention.
Figure 7B:
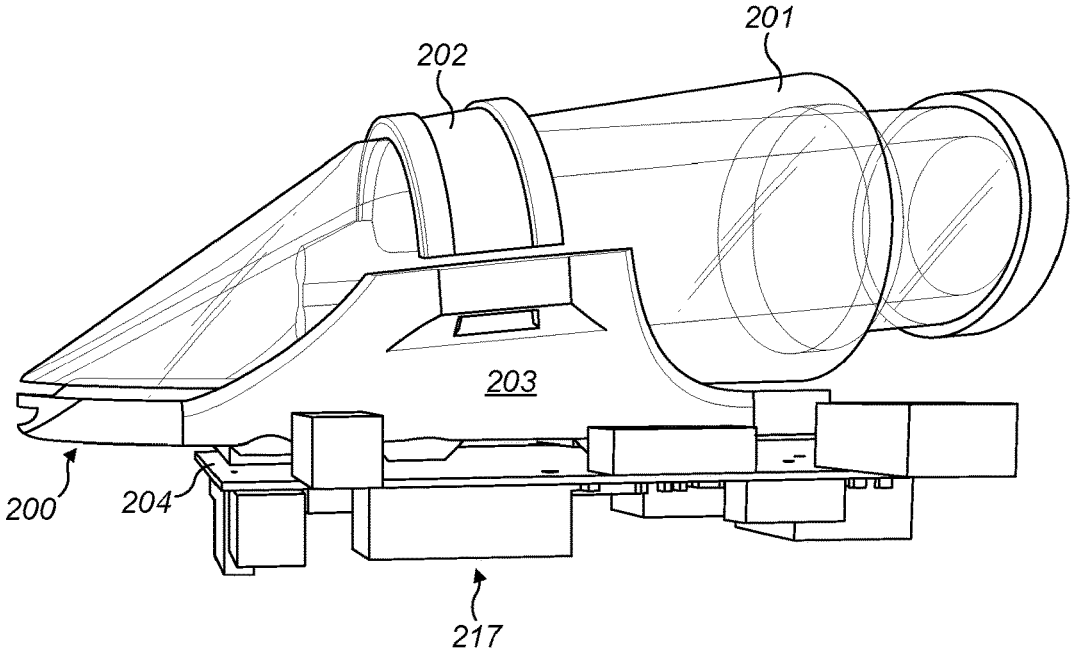
Figure 9:
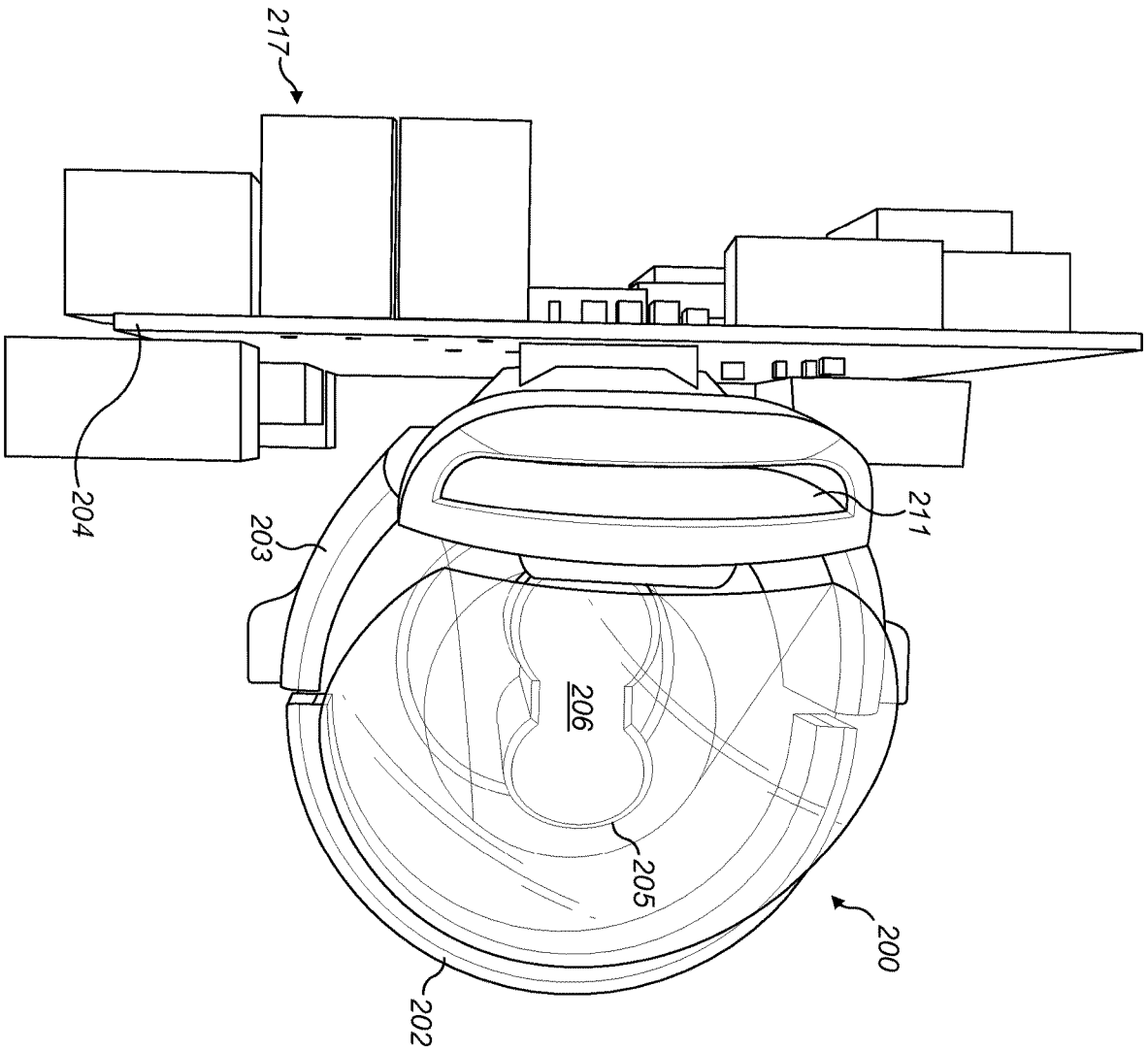
FIG. 9 is a first end view of the transducer apparatus of FIGS. 7*a*, 7*b* and 8.
Figure 10:
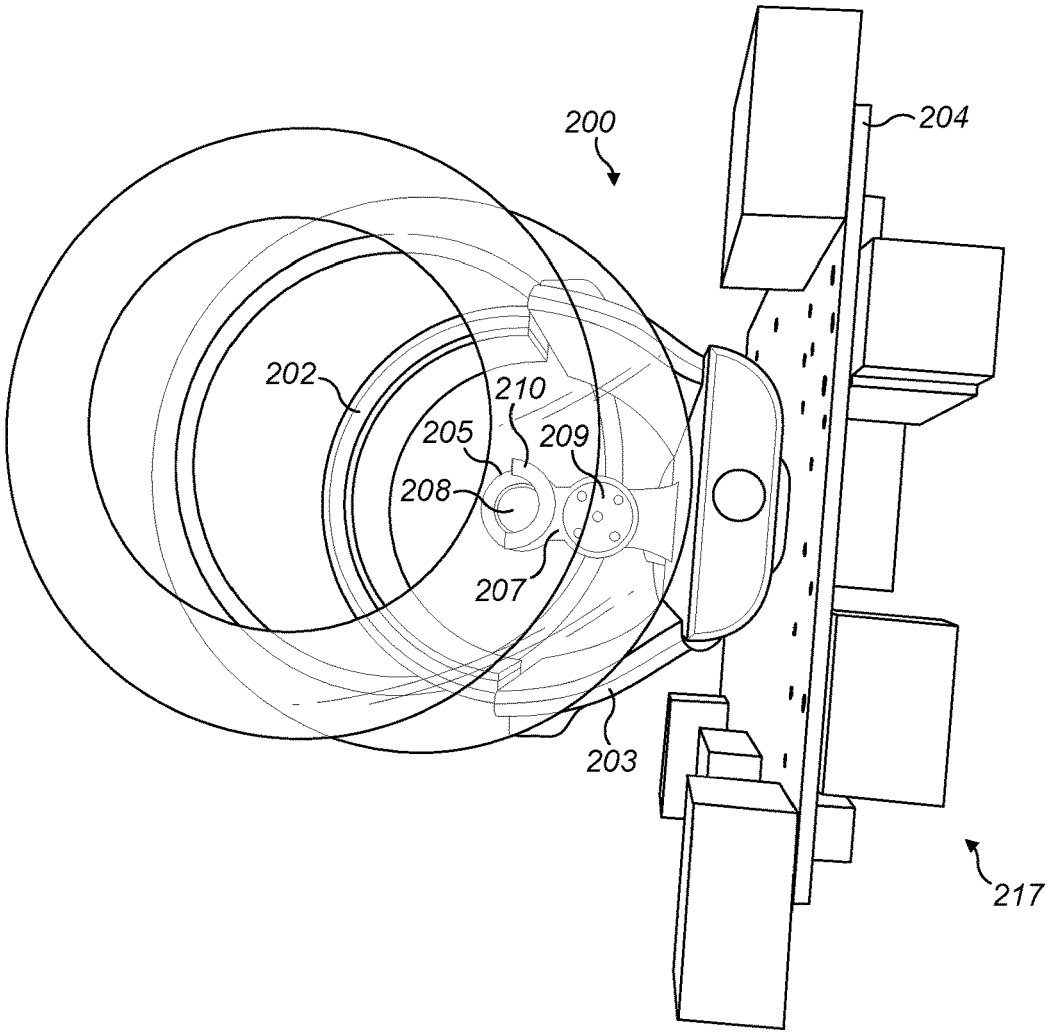
FIG. 10 is a second end view of the transducer apparatus of FIGS. 7*a* to 9.

FIGS. 7*a* to 11 show a transducer apparatus 200 according to a further embodiment of the invention. The transducer apparatus 200 is configured to be attachable to a mouthpiece 201 of a reed instrument, e.g. a clarinet, in place of the reed of the instrument. Typically a reed instrument will have a ligature which is used to releasably secure a reed in place on the mouthpiece 201. To use the transducer assembly 200 a player will loosen the ligature and release and remove the reed from the mouthpiece 201 (perhaps along with ligature). Then the transducer apparatus 200 is secured to the mouthpiece 201 in place of the reed, as shown in FIGS. 7*a* and 7*b*. The transducer apparatus has a collar 202, typically moulded from a plastic material, which is attached to a reed replacement section 203 of the apparatus. The reed replacement section 203 is also typically moulded from a plastic material and is U-shaped when viewed end on, as can be seen in FIGS. 9 and 10. In FIGS. 9 and 10 it can be seen that the collar 202 is also U-shaped when the apparatus is viewed end on. The collar 202 and reed replacement section 203 encircle the mouthpiece 201 when the transducer apparatus 200 is mounted on the mouthpiece 201, with the collar 202 extending over and engaging an 'upper' external surface of the mouthpiece 201 ('upper' in the sense that when the reed instrument is played in a conventional manner then the surface will point in an upward direction) and the collar 202 thereby securing the reed replacement section 203 to the mouthpiece in place of the reed normally secured to the mouthpiece 201. The reed replacement section 203 when secured in place will occupy the site on the mouthpiece usually occupied by a reed. An inwardly facing surface of the reed replacement section (facing inwardly toward the mouthpiece) engages and abuts a 'lower' external surface of the mouthpiece 201.

The transducer apparatus 200 has a printed circuit board 204 on which is mounted various electronic components which together provide the processing unit (217 in FIGS. 7*a* to 10, 100 in FIG. 4), the function of which has been described above and will be further described later. The printed circuit board 204 is attached to an exterior surface of the reed replacement section 203 which in use faces away from the mouthpiece 201.

As can be seen in FIGS. 9 and 10 the transducer apparatus 200 is provided with an arm 205 which is attached to the reed replacement section 203 and extends away therefrom, toward the collar 202. In use, when the transducer apparatus 200 is secured to the mouthpiece 201, the arm 205 will extend through an aperture in the lower external surface of the mouthpiece 201, into an air chamber 15 of the reed instrument. FIG. 9 shows a face 206 of the arm 205 which faces in use toward an end of the mouthpiece 201 engaged by lips of player. FIG. 10 shows a face 207 of the arm 205 which is uses faces away from the end of the mouthpiece 201 engaged by the lips of the player, e.g. a face 207 which faces towards the bell of a clarinet.

The arm 205 provides a housing for a speaker 208 and a microphone 209, as can be seen in FIG. 10, both of which open on to the face 207 of the arm 205. The speaker 208 in use will be positioned substantially centrally in the circular cross-section bore of the mouthpiece 201. The microphone 209 is located between the speaker 208 and the reed replacement section. Both the speaker 208 and the microphone 209 are connected electrically to the processing unit 217 by wires extending through the arm 205. A U-shaped barrier 210 extends out from the face 207 and shields the microphone 209 from the speaker 208 to reduce the amount of sound output from the speaker 208 that 'short circuits' directly to the microphone 209.

Figure 11:
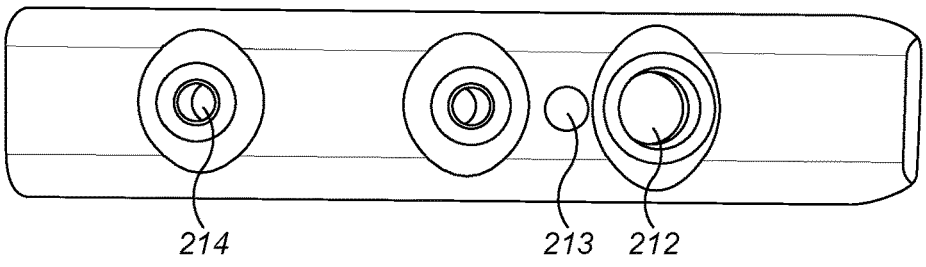
FIG. 11 is a view of one side of a component of the transducer apparatus of FIGS. 7*a* to 10.

The reed replacement section 203 has an air passage that extends therethrough from an inlet 211 shown in FIG. 9 to an outlet 213 shown in FIG. 11, which shows the lower external face of the reed replacement section 203. In use the player of the reed instrument will blow through the inlet 211. The passage between the inlet 211 and the outlet 213 is shaped and sized to provide a resistance to the air flow that will be similar to that experienced by the player of the instrument when playing the instrument with the reed attached. A pressure sensor 212 is housed in the reed replacement section 203 and measures air pressure in the passage between the inlet 211 and outlet 213. The pressure sensor 212 generates a pressure signal indicating when and how hard and in what manner (e.g. vibrato) the player blows into the passage. The pressure sensor is connected to the processing unit (217 in FIGS. 7*a* to 10, 100 in FIG. 4) provided by the electronics on the printed circuit board 204.

The transducer apparatus 200 is also provided with an ambient noise microphone 214 which faces outwardly of the apparatus 200 and which receives ambient sound surrounding the apparatus 200. The ambient noise microphone 214 produces an ambient noise signal which is relayed to the electronic signal processing unit (217 in FIGS. 7*a* to 10, 100 in FIG. 4) provided by the electronic components of the printed circuit board 204.

Batteries 215 and 216, preferably rechargeable, are provided on the printed circuit board 204 to power the electronic components on the board 204. Also a wireless transmitter 218 is provided to wirelessly transmit an output signal from the transducer apparatus 200, e.g. to the be received by a receiver of wireless headphones.

In use the transducer apparatus 200 will be mounted on the mouthpiece 201 of the reed instrument in place of a reed. The player will then blow through the inlet 211 of the apparatus while manually operating keys of the reed instrument to open and close tone holes of the instrument and thereby select a note to be played by the instrument. The blowing through the inlet 211 will be detected by the pressure sensor 212 which will send a pressure signal to the processing unit provided by the electronics on the printed circuit board 204. The processing unit (100,217), in response to the pressure signal indicating blowing of the player, will activate the excitation unit (101,222) of the processing unit (100, 217) to output an excitation signal to the speaker 208, which will then output sound to the air chamber 15 of the reed instrument. The frequency and/or amplitude of the excitation signal can be varied by the excitation unit (101, 222) having regard to the pressure signal output by the pressure sensor 212, so as to take account of how hard the player is blowing. Also air pressure variations measured by the pressure sensor 212 may be used to modulate the synthesized sounds, e.g. to recognise when the player is applying a vibrato breath input to the reed instrument and in response import a vibrato into the synthesized sounds. The frequency and/or amplitude of the excitation signal can also be varied by the excitation unit (101,222) having regard to the ambient noise signal output by the ambient noise microphone 214, e.g. to make sure that the level of sound output by the speaker 208 is at least greater than preprogramed minimum above the level of the ambient noise.

The microphone 209 will receive sound in the air chamber 15 and output a measurement signal to the processing unit (217 in FIGS. 7*a* to 10, 100 in FIG. 4). The processing unit (217,100) will compare the measurement signal or a spectrum thereof will pre-stored signals or pre-stored spectra, stored in a memory unit 219 on the printed circuit board 204 (also shown as 104 in FIG. 4) to find a best match (this could be done after removing from the measurement signal the ambient noise indicated by the ambient noise signal provided by the ambient noise microphone 214). Each of the pre-stored signals or spectra will correspond with a musical note. By finding a best match of the measurement signal or a spectrum thereof with the pre-stored signals or spectra the processing unit thereby determines the musical note played by the player of the reed instrument. The processor 102 incorporates a synthesizer 220 (see FIG. 8) which synthesizes an output signal representing the detected musical note. This synthesized musical note is output by the output means 103, e.g. via a wireless transmitter 218 (shown in FIG. 8) to wireless headphones, so that the player can hear the selected note output by the headphones. The processing unit (100,217) can additionally use the pressure signal and the ambient noise signal in the process of detecting what musical note has been selected and/or what musical note signal is synthesized and output (for instance the amplitude of the output signal might be varied in response to the pressure signal, since the pressure signal will indicate the strength of breath of the player and hence the loudness of the musical note desired by the player).

The transducer apparatus as described above has the following advantages:

i) It is a unit easily capable of being fitted to and removed from a mouthpiece of a standard reed instrument replacing the reed, or could be permanently fitted to a spare (inexpensive) mouthpiece.

ii) It has an integral pressure sensor which allows volume modulation of the excitation signal output by the speaker and also allows control of when a synthesized musical note is output. Also a pressure signal output by the pressure sensor can indicate when a vibrato air pressure is applied to the reed instrument and this allows a vibrato element to be incorporated in the synthesized musical note.

iii) It has integral embedded signal processing and wireless signal output.

iv) It allows communication of data to a laptop, tablet or personal computer/computer tablet/smart-phone application, with can run software providing a graphical user interface, including a visual display on a screen of live musical note spectra.

v) It can be provided optionally with a player operated integral excitation volume control.

vi) It can be provided with an ambient noise sensing microphone which allows integral ambient noise cancellation from the air chamber microphone measurement signal. It is preferred that the ambient noise microphone is as close to the instrument as possible to give an accurate ambient noise reading vii) Its processing unit (100, 217) comprises an integral synthesizer (220 in FIG. 8) providing a synthesized musical note output for aural feedback to the player.

viii) It comprises and is powered by an internal battery and so does not requires leads connected to the unit which might inhibit the mobility of the player of the reed instrument.

ix) It advantageously processes the microphone signal in electronics mounted on the reed instrument and hence close to microphone to keep low any latency in the system and to minimise data transmission costs and losses.

The invention as described in the embodiment above introduces an electronic stimulus by means of a small speaker 208 built in the transducer apparatus 200, placed near the connection of the mouth-piece to the remainder of the instrument. The stimulus is chosen such that the resonance produced by depressing any combination of key(s) causes the acoustic waveform, as picked up by at least one small microphone, e.g. the microphone 209 described above, preferably placed close to the stimulus provided by the speaker 208, to change. Therefore analysis of the acoustic waveform, when converted into an electric measurement signal by microphone 208, and/or derivatives of the signal, allows the identification of the intended note associated with the played key positions.

The stimulus provided via the speaker 208 can be provided with very little energy and yet with appropriate processing of the measurement signal, the intended note can still be recognised. This can provide to the player of the reed instrument the effect of playing a near-silent instrument.

The identification of the intended notes preferably gives rise to the synthesis of a musical note, typically, but not necessarily, chosen to mimic the type of reed instrument played. This electronic sound synthesis will be carried out by the sound synthesizer 220 provided on the printed circuit board 204. The synthesized sound will be relayed to headphones or other electronic interfaces such that a synthetic acoustic representation of the notes played by the instrument is heard by the player. Electronic processing can provide this feedback to the player in close to real-time, such that the instrument can be played in a natural way without undue latencies. Thus the player can practice the instrument very quietly without disturbing others within earshot.

The mouthpiece 201 of the instrument is modified by use of the transducer apparatus 200 to replace the reed typically mounted on the mouthpiece 201 of the reed instrument. The player expresses air into a small aperture provided by the inlet 211 to a passage which ends in a permanently open vent hole providing the outlet 213 to the outside of the instrument, typically in the vicinity of a junction between the mouthpiece 201 and a remainder of the reed instrument. The purpose of the vent hole is preferably two-fold; to mimic the normal playing air-pressure experienced by the player; and to provide a path for condensed moisture egress. Alternatively a second vent hole may be provided which is sealed until opened via a small key to allow for the ejection of condensed moisture. The dimensions of the or each vent hole are chosen to mimic the normal range of pressures exerted when playing a conventional instrument.

As mentioned above the air pressure within the passage between the inlet 211 and outlet 213 is detected by the pressure sensor 212. Typically an analogue signal representing the measured pressure is provided to the electronic processing unit shown as 100 in FIG. 4 and as 217 in FIGS. 7*a* to 10. The absolute value of, or changes in, air pressure may be used to initiate application of the stimulus, and/or processing of the microphone signal(s) and/or generation of the synthesized mimic sound. The air pressure variations may also be used to modulate the synthesized sound e.g. when vibrato is applied. There is no air passage between inlet 211 and the remainder of the instrument, so the breath of the player cannot reach the air chamber 15 of the reed instrument.

The electronic processing unit (100,217) will use one or more of a variety of well-known techniques for analysing the measurement signal in order to discover a transfer function of the resonant cavity provided by the air chamber 15 of the reed instrument, and thereby the intended note, working either in the time domain or the frequency domain. These techniques include application of maximum length sequences either on an individual or repetitive basis, time-domain reflectometry, swept sine analysis, chirp analysis, and mixed sine analysis.

An embodiment based on the consecutive application of simple sine tones will now be described, but alternate processing methods may be used.

In the preferred embodiment the stimulus signal sent to the speaker, e.g. speaker 208, will be a stimulus-frame comprised of tone fragments chosen for each of the possible musical notes of the instrument. The tones can be applied discretely or contiguously following on from each other. Each of the tone fragments may be comprised of more than one frequency component. The tone fragments are arranged in a known order to comprise the stimulus-frame. The stimulus-frame is applied as an excitation to the speaker (e.g. 208) typically being initiated by the player blowing into the instrument (as detected by the pressure sensor 212). A signal comprising a version of the stimulus-frame as modified by the acoustic transfer function of the air chamber (as set by any played keys and resonances generated thereby) is picked up by the microphone 209. The time-domain measurement signal is processed, e.g. by a filter bank or fast Fourier transform (fft), to provide a set of measurements at known frequencies. The frequency measures allow recognition of the played note, either by comparison with pre-stored frequency measurements of played notes or by comparison with stored frequency measurements obtained via machine learning techniques. Knowledge of ordering and timing within the stimulus-frame may be used to assist in the recognition process.

The stimulus-frame typically is applied repetitively on a round-robin basis for the period that air-pressure is maintained by the player (as sensed by the pressure sensor 212). The application of the stimulus frame will be stopped when the pressure sensor 212 gives an pressure signal indicating that the player has stopped blowing and the application of the stimulus frame will be re-started upon detection of a newly timed note as indicated by pressure sensor 212. The timing of a played note output signal, output by a component of the processing unit (217 in FIGS. 7*a* to 10, 100 in FIG. 4), on identification of a played note, is preferably determined by a combination of the recognition of the played note and the measured air-pressure. The played note output signal is then input to synthesis software run on the synthesizer 220 such that a mimic of the played note is output by the synthesizer 220 of the processing unit (217 in FIGS. 7*a* to 10, 100 in FIG. 4), the synthesized musical note signal and the timing thereof are offered back to the player typically for instance via wireless headphones.

It is desirable to provide the player with low-latency feedback of the played note, especially for low frequency notes where a single cycle of the fundamental frequency may take tens of milliseconds. A combination of electronic processing techniques may be applied to detect such notes with low latency by applying a tone or tones at different frequencies to the fundamental such that the played note may still be detected from the response.

On some reed instruments the played note is changed by means of one or more register or octave-key(s) opening at least one additional 'vent', or alternatively by 'over-blowing' (i.e. the player blowing at a significantly higher pressure) such that a harmonic sounds rather than the fundamental. Over-blowing may be detected by the pressure sensor 212 through the additional air-pressure exerted. Use of a register or octave-key causes the resonant frequency of the fundamental to move slightly without significantly affecting the frequency of the higher harmonics and thus provides a basis for recognition through the measurement signal provided by the microphone 209. Alternatively the position of the register or octave-key could be detected via a variety of conventional methods, e.g. by use of a magnetic switch or a micro-switch.

In a further embodiment the excitation signal sent to the speaker 208 is an exponential chirp running from 20 Hz to 20 kHz. The signal will include a lowest frequency in the range 20 Hz to 200 Hz. This signal excites the air chamber of the reed instrument via the loudspeaker on a repetitive basis, thus forming a stimulus-frame. The starting frequency of the scan is chosen to be below the lowest fundamental (first harmonic) of the instrument, roughly 150 Hz in the case of a Bflat clarinet.

It should be noted that on many reed instruments the opening associated with the register key is physically small in relation to the other key openings. This has the effect of the opening being largely transparent to high frequencies since the phase of the waveform reverses before significant sound energy can escape through the small hole. It is important that the bottom scan frequency of the chirp signal provided by the stimulus-frame sent to the microphone is at least as low as the lowest fundamental frequency of the instrument, e.g. ~150 Hz on a standard Bflat clarinet.

The sound present in the air chamber 15 is sensed by the microphone 209 and assembled into a frame of data lasting exactly the same length as the exponential chirp excitation signal (which provides the stimulus-frame). Thus the frames of microphone data and the chirp are synchronised.

An FFT is performed upon the frame of data in the measurement signal provided by the microphone 209 and a magnitude spectrum is thereby generated in a standard way.

The transducer apparatus in this embodiment preferably has a training mode in which the player successively plays all the notes of the instrument and the resultant magnitude spectrum of the measurement signals provided by the microphone are stored correlated to the notes being played. Preferably the transducer apparatus is provided with a signal receiver as well as its signal transmitter and thereby communicates with a laptop, tablet or personal computer or a smartphone running application software that enables player control of the transducer apparatus. The application software allows the player to select the training mode of the transducer apparatus. Typically the memory unit (104, 219) of the apparatus will allow three different sets of musical note data to be stored. The player will select a set and then will select a musical note for storing in the set. The player will manually operate the relevant keys of the instrument to play the relevant musical note and will then use the application software to initiate recording of the measurement signal from the microphone 209. The transducer apparatus will then cycle through a plurality of cycles of generation of an excitation signal and will average the measurement signals obtained over these cycles to obtain a good reference response for the relevant musical note. The process is then repeated for each musical note played by the instrument. When all musical notes have been played and reference spectra stored, then the processing unit (217 in FIGS. 7*a* to 10, 100 in FIG. 4) has a set of stored spectra in memory (104, 219) which comprise a training set. Several (e.g. three) training sets may be generated (e.g. for different instruments), for later selection by the player. The laptop, tablet or personal computer or smartphone will preferably have a screen and will display a graphical representation of each played musical note as indicated by the measurement signal. This will enable a review of the stored spectra and a repeat of the learning process of the training mode if any defective musical note data is seen by the player.

Rather than use application software on a separate laptop, tablet or personal computer or smartphone, the software could be run by the electronic processing unit (100, 217) of the transducer apparatus 200 itself and manually operable controls, e.g. buttons, provided on the transducer apparatus 200, along with a small visual display, e.g. LEDs, that provides an indication of the selected operating mode of the apparatus 200, musical note selected and data set selected.

An accelerometer 221 (see FIG. 8) could be provided in the transducer apparatus 200 to sense motion of the transducer apparatus 200 and then the player could move the instrument to select the input of the next musical note in the training mode, thus removing any need for the player to remove his/her from the instrument between playing of musical notes. Alternatively, the electronic processing unit (100,217) or a laptop, tablet or personal computer or smartphone in communication therewith could be arranged to recognise a voice command such as 'NEXT' received e.g. through the ambient noise microphone 214 or a microphone of the laptop, tablet or personal computer or smartphone. As a further alternative, the pressure signal provided by the pressure sensor 212 could be used in the process, recognising an event of a player stopping blowing and next starting blowing (after a suitable time interval) as a cue to move from learning one musical note to the moving to learning the next musical note.

When the transducer apparatus 200 is then operated in play mode a pre-stored training set is pre-selected. The selection can be made using application software running on a laptop, tablet or personal computer or on a smartphone in communication with the transducer apparatus. Alternatively the transducer apparatus 200 could be provided with manually operable controls to allow the selection. The magnitude spectrum is generated from the measurement signal as above, but instead of being stored as a training set it is compared with each of the spectra in the training set (each stored spectrum in a training set representing a single played note). A variety of techniques may be used for the comparison, e.g. a least squares difference technique or a maximised Pearson second moment of correlation technique. Additionally machine learning techniques may applied to the comparison such that the comparison and or training sets adjusted over time to improve the discrimination between notes.

It is convenient to use only the magnitude spectrum of the measurement signal from a simple understanding and visualisation perspective, but the full complex spectrum of both phase and amplitude information (with twice as much data) could also be used, in order to improve the reliability of musical note recognition. However, the use of just the magnitude spectrum has the advantage of speed of processing and transmission, since the magnitude spectrum is about 50% of the data of the full complex spectrum. References to 'spectra' in the specification and claims should be considered as references to: magnitude spectra only; phase spectra only; a combination of phase and amplitude spectra; and/or complex spectra from which magnitude and phase are derivable.

In an alternative embodiment a filter bank, ideally with centre frequencies logarithmically spaced, could be used to generate a magnitude spectrum, instead of using a Fast Fourier Transform technique. The centre frequencies of the filters in the back can be selected in order to give improved results, by selecting them to correspond with the frequencies of the musical notes played by the reed instrument.

Thus the outcome of the signal processing is a recognised note, per frame (or chirp) of excitation. The minimum latency is thus the length of the chirp plus the time to generate the spectra and carry out the recognition process against the training set. The processing unit (217 of FIGS. 7*a* to 10, 100 of FIG. 4) of the preferred embodiment typically runs at 93 ms for the excitation signal and ~30 ms for the signal processing of the measurement signal. It is desirable to reduce the latency even further; an FFT approach this will typically reduce the spectral resolution since fewer points will be considered, assuming a constant sample rate. With a filter bank approach there will be less processing time available and the filters will have less time to respond, but the spectral resolution need not necessarily be reduced.

As with the other preferred embodiments, the recognised note is synthesized immediately and fed back to the player via wired headphones. Alternatively the synthesized musical note may be transmitted to be used by application software running on a laptop, tablet or personal computer or smartphone or other connected processor. The connection may be wired or preferably wireless using a variety of means, e.g. Bluetooth®. Parameters which are not critical to operation but which are useful, e.g. the magnitude spectrum, may also be passed to the application software for every frame. Thus the application software can generate an output on a display screen which allows the player to see a visual effect in the frequency spectrum of playing deficiencies of the player e.g. a failure to totally close a hole. This allows a player to adjust his/her playing and thereby improve his/her skill.

In a further embodiment of the invention an alternate method of excitation signal generation and processing the measurement signal is implemented in which an excitation signal is produced comprising of a rich mixture of frequencies, typically harmonically linked. The measurement signal is analysed by means of a filter-bank or fft to provide a complex frequency spectrum. Then the complex frequency spectrum is run through a recognition algorithm in order to provide a first early indication of the played note. This could be via a variety of recognition techniques including those described above. The first early indication of the played note is then used to dynamically modify the mixture of frequencies of the excitation signal in order to better discriminate the played note. Thus the recognition process is aided by feeding back spectral stimuli which are suited to emphasising the played note. The steps are repeated on a continuous basis, perhaps even on a sample by sample basis. A recognition algorithm provides the played note as an additional output signal.

In the further embodiment the content of the excitation signal is modified to aid the recognition process. This has parallels with what happens in the conventional playing of a reed instrument in that the reed provides a harmonic rich stimulus which will be modified by the acoustic feedback of the reed instrument, thus reinforcing the production of the played note. However, there are downsides in that a mixture of frequencies as an excitation signal will fundamentally produce a system with a lower signal to noise ratio (SNR) than that using a chirp covering the same frequencies, as described above. This is because the amplitude at any one frequency is necessarily compromised by the other frequencies present if the summed waveform has to occupy the same maximum amplitude. For instance if the excitation signal comprises a mixture of 32 equally weighted frequencies, then the overall amplitude of the sum of the frequencies will be 1/32 of that achievable with a scanned chirp over the same frequency range and this will reflect in the SNR of the system. This is why use of a scanned chirp as an excitation signal, as described above, has an inherent superior SNR; but the use of a mixture of frequencies in the excitation signal which is then enhanced might enable the apparatus to have an acceptably low latency between the note being played and the note being recognised by the apparatus.

With suitable communications, application software running on an device external to the instrument and/or the transducer apparatus may also be used to provide a backup/restore facility for the complete set of instrument data, and especially the training sets. The application software may also be used to demonstrate to the user the correct spectrum by displaying the spectrum for the respective note from the training set. The displayed correct spectrum can be displayed alongside the spectrum of the musical note currently played, to allow a comparison.

Since the musical note and its volume are available to the application software per frame, a variety of means may be used to present the played note to the player, These include a simple textual description of the note, e.g. G#3, or a (typically a more sophisticated) synthesis of the note providing aural feedback, or a moving music score showing or highlighting the note played, or a MIDI connection to standard music production software e.g. Sibelius, for display of the live note or generation of the score.

The application software running on a laptop, tablet or personal computer or smartphone in communication with the transducer apparatus and/or as part of the overall system of the invention will allow: display on a visual display unit of a graphical representation of a frequency of a played note; the selection of a set of data stored in memory for use in the detection of a played note by the apparatus; player control of volume of sound output by the speaker; adjustment of gain of the pressure sensor; adjustment of volume of playback of the synthesized musical note; selection of a training mode or a playing mode operation of the apparatus; selection of a musical note to be learned by the apparatus during the training mode; a visual indication of progress or completion of the learning of a set of musical notes during the training mode; storage in the memory of the laptop, tablet or personal computer or smartphone (or in cloud memory accessed by any of them) of the set of data stored in the on-board memory of the transducer apparatus, which in turn will export (e.g. for restoration purposes) of set of data to the on-board memory (104, 219) of the transducer apparatus 200; a graphical representation, e.g. in alphanumeric characters, of the played note; a musical note by musical note graphical display of the spectra of the played notes, allowing continuous review by the player; generation of e.g. pdf files of spectra. The application software could additionally be provided with feature enabling download and display of musical scores and exercises to help those players learning to play an instrument.

Whilst above the identification of a played note and the synthesis of a musical note is carried out by electronics on-board to the transducer apparatus, these processes could be carried out by separate electronics physically distant from but in communication with the apparatus mounted on the instrument or indeed by the application software running on the laptop, tablet or personal computer or smartphone. The generation of the excitation signal could also occur in the separate electronics physically distant from but in communication with the apparatus mounted on the instrument or by the application software running on the laptop, tablet or personal computer or smartphone.

In modifications of the embodiments described above at least a second channel of processing is provided with one of more independent ambient noise microphone(s) 214, which can be placed on the printed circuit board 204. The independent ambient noise microphone(s) 214 will measure sound external to the air chamber 15. This provides two possibilities:

a) The external microphone signal(s) may be used to reduce external ambient noise, either directly by providing an ambient noise signal processed with the measurement signal provided by the internal microphone 209 to remove the ambient noise from the measurement signal prior to e.g. FFT processing and recognition. Alternatively the complex or magnitude spectrum of the ambient signal can be generated and removed from the respective spectrum of the measurement signal provided by the microphone 209.

b) The external microphone signal(s) may alternatively or additionally be used to reduce the effect of ambient noise upon the note recognition process by dynamically increasing the volume of the speaker 208 to help overcome the ambient noise on a frame by frame basis.

The transducer apparatus 200 will preferably retain in memory (104, 219) the master state of the processing and all parameters, e.g. a chosen training set. Thus the transducer apparatus 200 is programmed to update the process implemented thereby for all parameter changes. In many cases the changes will have been initiated by application software on the laptop, tablet or personal computer or smartphone, e.g. choice of training note. However, the transducer apparatus 200 will also generate changes to state locally, e.g. the pressure currently applied as noted by the pressure sensor 212 or the note currently most recently recognised.

The embodiments of the invention above could be modified by the addition of an accelerometer included in the apparatus. The signal from the accelerometer would indicate movement of the reed instrument and thereby provide the player with expression control and/or automatic power-up/power-down governed by instrument movement. This control could be implemented either in the electronics mounted to the reed instrument or in application software run on a laptop, tablet or personal computer or smartphone in communication with the device mounted on the reed instrument.

Whilst above an electronic processing unit (100, 217) is included in the device coupled to the reed instrument which provides both an excitation signal and outputs a synthesized musical note, a fast communication link between the instrument mounted device and a laptop, tablet or personal computer or smartphone would permit application software on the laptop, tablet or personal computer or smartphone to generate the excitation signal which is then relayed to the speaker mounted on the instrument and to receive the measurement signal from the microphone and detect therefrom the musical note played and to synthesize the musical note played e.g. by a speaker of the laptop, tablet or personal computer or smartphone or relayed to headphones worn by the player. A microphone built into the laptop, tablet or personal computer or smartphone could be used as the ambient noise microphone. The laptop, tablet or personal computer or smartphone would also receive signals from a pressure sensor and/or an accelerometer when they are used.

The synthesized musical notes sent e.g. to headphones worn by a player of the reed instrument could mimic the reed instrument played or could be musical notes arranged to mimic sounds of a completely different instrument. In this way an experienced player of a reed instrument could by way of the invention play his/her reed instrument and thereby generate the sound of a e.g. a played guitar. This sound could be heard by the player only by way of headphones or broadcast to an audience via loudspeakers. This can be particularly useful for the practice of certain reed instruments, e.g. bass reed instruments are very large and expensive, since being able to practice a piece of music on a Bflat clarinet fitted with the present invention will be far more convenient in many circumstances (e.g. when travelling) than practising on the bass instrument itself.

The invention claimed is:

1. A system for representing sounds of a reed instrument, the system comprising:

output means;

a speaker driven to produce sound by an excitation unit, said speaker being arranged to deliver sound to an air chamber of the reed instrument;

a microphone arranged to receive sound in the air chamber and to provide a measurement signal; and a processing unit arranged to receive the measurement signal, wherein the system has an operating mode in which:

the processing unit generates from the measurement signal an output signal indicative of which musical note is being played by the reed instrument; and the output means outputs the output signal;

wherein the system comprises additionally a pressure sensor, separate and independent from the microphone, which sends a signal to the processing unit to indicate when a user of the reed instrument is blowing through a mouthpiece of the reed instrument.

2. The system of claim 1, wherein the signal sent by the pressure sensor to the processing unit additionally indicates how hard the user is blowing through the mouthpiece.

3. The system of claim 1, wherein the processing unit generates from the measurement signal a difference signal comprising a time series of data characterising a difference between the sound produced by the speaker and the sound received by the microphone.

4. The system of claim 1, wherein in the operating mode the excitation unit is arranged to drive the speaker to produce sound at a range of frequencies which includes a lowest frequency of between 20 Hz and 200 Hz.

5. The system of claim 1, wherein the excitation unit is arranged to drive the speaker with an exponential chirp.

6. The system of claim 1, further comprising means for obtaining a measurement of ambient noise, wherein in the operating mode the excitation unit is arranged to drive the speaker to produce sound at an output power chosen based on a measurement of ambient noise.

7. The system of claim 6, wherein the measurement of ambient noise is made by the microphone or by a separate and independent ambient noise microphone.

8. The system of claim 1, wherein the excitation unit is arranged to drive the speaker to produce a continuous output sound or a series of repeated chirps.

9. The system of claim 1, wherein the excitation unit is arranged to drive the speaker to produce a set of tones or repeated sets of tones.

10. The system of claim 1, further comprising a memory that stores a set of tones, wherein:

each tone is associated with a note that may be produced by the reed instrument; and the excitation unit is arranged to drive the speaker to produce a sequence of each of the stored tones.

11. The system of claim 1, wherein the processing unit is arranged to produce the output signal by synthesizing the sound of a reed instrument, and the output means is one or more of: a speaker; headphones; and/or earphones.

12. The system of claim 1, wherein the output means is one or more of: an interface for a computer; a midi connection; a wireless device for exchanging data over short distances using short-wavelength UHF radio waves; and/or a transmitter.

13. The system of claim 1, wherein the speaker and microphone are separated in the air chamber by a distance of less than 5 cm.

14. The system of claim 1, wherein the speaker and microphone are mounted on a housing, the housing being adapted for attachment to the reed instrument such that the speaker and microphone are in communication with the air chamber.

15. The system of claim 14, wherein:

the housing is adapted for attachment to a mouthpiece of the reed instrument; and the housing is arranged to form a barrier between the mouthpiece and the air chamber.

16. The system of claim 15, wherein the pressure sensor is mounted on the housing for communication with the mouthpiece.

17. The system of claim 1, wherein the speaker, the microphone and the pressure sensor are mounted on a housing, the housing being adapted for attachment between a mouthpiece and an air chamber of a reed instrument such the speaker and microphone are in communication with the air chamber and the pressure sensor is in communication with the mouthpiece.

18. The system of claim 17, wherein:

the mouthpiece comprises a tip with an opening in communication with the air chamber;

the system comprises a false reed extending along the mouthpiece;

the false reed has formed therein a groove or passage extending to a bleed hole formed in the false reed; and the pressure sensor is mounted to sense air pressure in the passage.

19. The system of claim 1, wherein:

the speaker, the microphone and the pressure sensor are mounted on a housing, the housing being adapted for attachment to the reed instrument such that the speaker and microphone are in communication with the air chamber;

the housing forms a mouthpiece;

a bore extends through the mouthpiece, the bore being separate from the air chamber; and the pressure sensor is mounted to sense air pressure in the bore.

20. The system of claim 19, wherein the bore connects an inlet to a bleed hole.

21. The system of claim 1, wherein the processing unit generates the output signal based on the frequency content and/or timing of the measurement signal.

22. The system of claim 20, wherein the processing unit generates the output signal as representative of both air pressure sensed by the pressure sensor and a characteristic of a difference between the sound produced by the speaker and the sound received by the microphone.

23. The system of claim 20, wherein the processing unit generates the output signal by synthesizing a sound of a reed instrument, with the frequency of the synthesized sound being based on frequency content of the measurement signal and also based on the air pressure sensed by the air pressure sensor, and with the amplitude of the synthesized sound being based on the air pressure sensed by the air pressure sensor.

24. Transducer apparatus for use with a reed instrument having an air chamber forming a resonant cavity whose resonance characteristics are controlled by opening and closing of tone holes connecting the air chamber to the exterior of the reed instrument, the transducer apparatus comprising:

attachment means for releasably securing the transducer apparatus to a mouthpiece of the reed instrument in place of a reed;

a reed replacement section having a housing with an abutment surface for abutting a surface part of the mouthpiece which would be abutted by a reed secured to the mouthpiece;

an air passage through the housing of the reed replacement section extending from an air inlet through which a player of the instrument can blow to an air outlet through which air blown by the player is delivered to atmosphere without passing through an air chamber within the reed instrument;

a speaker supported by housing for delivering sound to the air chamber of the reed instrument;

an air chamber microphone supported by the housing for receiving sound in the air chamber of reed instrument; and an electronic processing unit having: an excitation unit which produces an excitation signal for driving the speaker; a processor which receives a measurement signal produced by the air chamber microphone and which detects from the measurement signal a musical note played by the instrument; a synthesizer which generates an electronic signal embodying a musical note which corresponds to the detected musical note; and output means which transmits the musical note generated by the synthesizer to a receiver external of the transducer apparatus.

25. Transducer apparatus as claimed in claim 24 comprising additionally a pressure sensor which senses air pressure in the air passage of the housing and provides a pressure signal indicative of the sensed air pressure, wherein the electronic processing unit uses the sensed air pressure in controlling one or more of: timing of commencement or cessation of production of the excitation signal; timing of generation of the electronic signal by the synthesizer; and amplitude of the electronic signal generated by the synthesizer.

* * * * *